US005727506A

United States Patent [19]

Tajima et al.

[11] Patent Number: 5,727,506

[45] Date of Patent: Mar. 17, 1998

[54] TWO-STROKE INTERNAL COMBUSTION ENGINE

[75] Inventors: Katsuya Tajima, Hamura; Hiroaki Koga, Sayama; Hiroji Kawasaki, Ohme, all of Japan

[73] Assignee: Kioritz Corporation, Tokyo, Japan

[21] Appl. No.: 755,032

[22] Filed: Nov. 22, 1996

[30] Foreign Application Priority Data

Nov. 30, 1995 [JP] Japan ..... 7-313371

[51] Int. Cl.[6] ..... F02B 33/04

[52] U.S. Cl. ..... 123/73 A

[58] Field of Search ..... 123/73 A, 73 R, 123/73 PP, 73 B

[56] References Cited

U.S. PATENT DOCUMENTS

| | | | |
|---|---|---|---|
| 2,682,259 | 6/1954 | Watkins | 123/73 A |
| 3,132,635 | 5/1964 | Heidner | 123/73 A |
| 3,859,967 | 1/1975 | Turner et al. | 123/73 A |
| 3,929,111 | 12/1975 | Turner et al. | 123/73 A |
| 4,181,101 | 1/1980 | Yamamoto | 123/73 A |
| 4,286,553 | 9/1981 | Baltz et al. | 123/73 A |
| 4,359,975 | 11/1982 | Heidner | 123/73 R |
| 4,383,503 | 5/1983 | Griffiths | 123/73 PP |
| 4,590,897 | 5/1986 | Hundertmark | 123/73 A |
| 4,690,109 | 9/1987 | Ogasahara et al. | 123/73 PP |
| 4,711,225 | 12/1987 | Holderle et al. | 123/590 |
| 4,712,523 | 12/1987 | Matsubayashi | 123/188 M |
| 4,770,132 | 9/1988 | Sougawa | 123/73 A |
| 4,890,587 | 1/1990 | Holtermann | 123/73 A |

FOREIGN PATENT DOCUMENTS 59-30203 8/1984 Japan .

*Primary Examiner*—David A. Okonsky

*Attorney, Agent, or Firm*—Brumbaugh, Graves, Donohue & Raymond

[57] ABSTRACT

To avoid stalling of a two-stroke internal combustion engine as its orientation is changed upon a change of direction in which a working machine such as a chain saw is held, non-atomized fuel is prevented from flowing precipitously into the combustion chamber of the engine. The engine comprises a crank case forming a crank chamber which has an intake port opening into the crank chamber, and a flow control feature at the circumferential inner surface of the crank chamber in the vicinity of the intake port for retarding flow of non-atomized fuel.

3 Claims, 3 Drawing Sheets

TWO-STROKE INTERNAL COMBUSTION ENGINE

TECHNICAL FIELD

The present invention relates to a two-stroke internal combustion engine suitable for use in a portable power working machine.

BACKGROUND OF THE INVENTION

In a portable power working machine which can be turned to change operational direction or orientation, e.g. a chain saw, a small air-cooled two-stroke gasoline engine (hereinafter also referred to as a two-stroke internal combustion engine or simply as an engine) is popular as a power source. Typically, such an engine has a longitudinal dimension or height which is greater than a diametrical dimension or width, and, when used in a small-sized chain saw or the like, it is disposed in a casing of the chain saw.

With such a two-stroke internal combustion engine, there is a difficulty in that, if the working machine such as a chain saw is operated for a period of time with its distal end down or with its operative portion slanting down and then is turned up and held with its distal end up or with its operative portion slanting up, the engine is likely to decelerate abruptly, and to be prone to engine stall.

This applies to engines disclosed in Japanese laid open Utility Model Document No. 140402/1981, wherein an intake port is formed in a bottom (situated laterally as the engine is laid down) of a crank chamber. An air-fuel mixture from a carburetor is introduced by suction into the crank chamber from the intake port via a lead valve and pre-pressurized there and supplied to a combustion chamber through scavenging paths which are in communication with the crank chamber.

SUMMARY OF THE INVENTION

Cause of the above-mentioned difficulty has been identified and found to be as follows: While the working machine is held with its distal end down or with its operative portion slanting down, i.e., with the intake side of the crank chamber of the engine down or obliquely down, non-atomized fuel deposited on the inner surface, in particular on a circumferential inner surface of the crank chamber flows to the region of the intake port and collects there. If the working machine is then turned up and held with its distal end up or with its operative portion slanting up, the non-atomized fuel flows along the inner surface of the crank chamber into the scavenging paths and therefrom flows or gushes precipitously into the combustion chamber. This results in an excessive proportional amount of fuel in the air-fuel mixture. Thus, it has been found that the above difficulty results from an undesired flow of the non atomized fuel due to the directional change of the engine upon a directional change of holding of the working machine.

When the engine is running at high speed, fuel is supplied at a high rate. Accordingly, even if non-atomized fuel precipitously flows into the combustion chamber as described, no serious difficulty arises. On the other hand, when the engine is idling, fuel is supplied at a low rate, and if non-atomized fuel gushes into the combustion chamber as described, the air-fuel mixture becomes too rich. This can lead to engine stall.

It is an object of the present invention to provide a two-stroke internal combustion engine in which undesired flow of non-atomized fuel is minimized on an inner surface of the crank chamber, in particular a circumferential inner surface, substantially to prevent engine stalling due to non-atomized fuel precipitously flowing into the combustion chamber even if the direction of the engine is changed upon a change of direction in which the working machine is held.

A preferred two-stroke internal combustion engine comprises a crank case defining a crank chamber and having an intake port opening into the crank chamber, and a flow control feature for impeding flow of non-atomized fuel. The flow control feature is provided at a circumferential inner surface of the crank chamber in the vicinity of the intake port.

The flow control feature may be in any suitable form, provided it is capable of serving to prevent non-atomized fuel from flowing along the circumferential inner surface of the crank case, thereby to retard or impede the flow of the non-atomized fuel. Preferably, the flow control feature comprises a weir, groove or recess. Preferred direction and extent of such a weir, groove or recess is parallel to the crank shaft and extending across the full width of the crank chamber.

In the preferred two-stroke internal combustion engine as described above, by virtue of the flow control feature provided at the circumferential inner surface of the crank chamber in the vicinity of the intake port, non-atomized fuel which has collected in the region of the intake port and which would otherwise flow into the crank chamber upon directional change of the engine is impeded, thereby greatly to retard the flow of the non-atomized fuel. As a result, non-atomized fuel is prevented from flowing along the circumferential inner surface of the crank chamber into the combustion chamber, and engine stall or the like is prevented.

DESCRIPTION OF A PREFERRED EMBODIMENT

Figure 1:
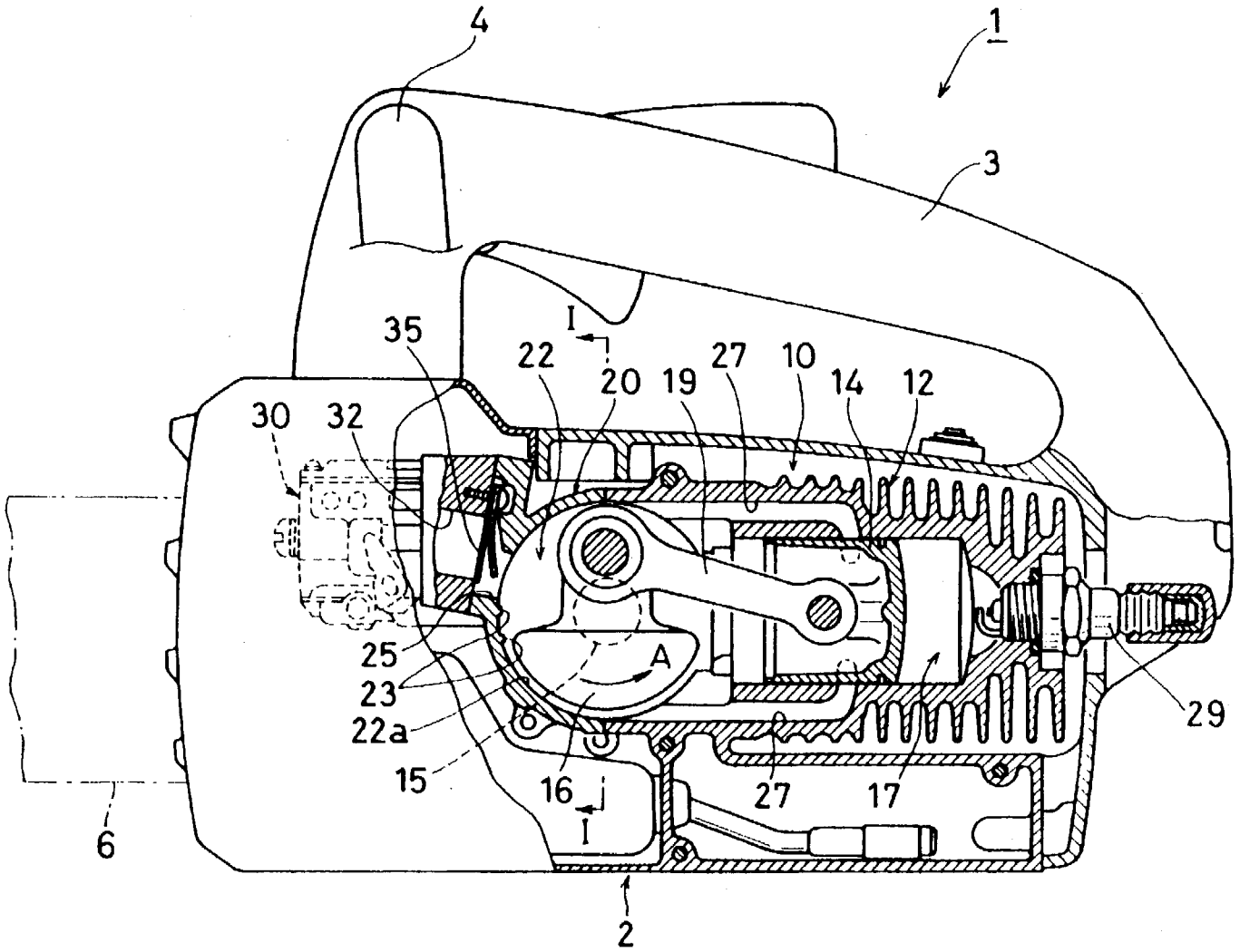
FIG. 1 is a partially cut-away side view of a chain saw including a preferred embodiment of the two-stroke internal combustion engine.

FIG. 1 shows a chain saw 1 having a casing 2 and an operative portion 6 including a saw chain which is detachably attached to the casing 2 and which projects therefrom. A main handle 3 is disposed on top of the casing 2, and a loop-shaped auxiliary handle 4 whose upper end is attached to the main handle 3 is disposed in a fore portion of the left side of the main handle 3.

Within the casing 2, a small air-cooled two-stroke gasoline engine 10 is disposed with its cylinder head in back, i.e., with its cylinder block 12 in back and its crank case 20 in front.

A piston 14 is inserted in the cylinder block 12, and a combustion chamber 17 is thereby defined by the top of piston 14 and the inner surface of the cylinder block 12. A spark plug 29 is provided in the top of the cylinder block 12 and into the combustion chamber 17.

The reciprocating motion of the piston 14 is converted via a connecting rod 19 into rotational motion of a crank shaft 15 which is journaled by a bearing (not shown) held between the semi-cylindrical crank case 20 and the bottom of the cylinder block 12. By rotation of the crank shaft 15, a balance weight 16 mounted thereon is rotated in a crank chamber 22 defined by the crank case 20 and a lower portion of the cylinder block 12, in the direction of the arrow A in FIGS. 1 and 3.

The crank chamber 22 has an intake port 25 at a slightly elevated position at the bottom of the crank case 20, as shown on the left side of the engine 10 in FIG. 1. An air-fuel mixture is delivered from a diaphragm-type carburetor 30 to the crank chamber 22 through an air-fuel mixture supply path 32 formed in an insulator, and the air-fuel mixture is introduced by suction into the crank chamber 22 from the intake port 25 via a lead valve 35. The air-fuel mixture is pre-pressurized in the crank chamber 22 and supplied to the combustion chamber 17 through scavenging paths 27 which are in communication with the crank chamber 22.

Figure 2:
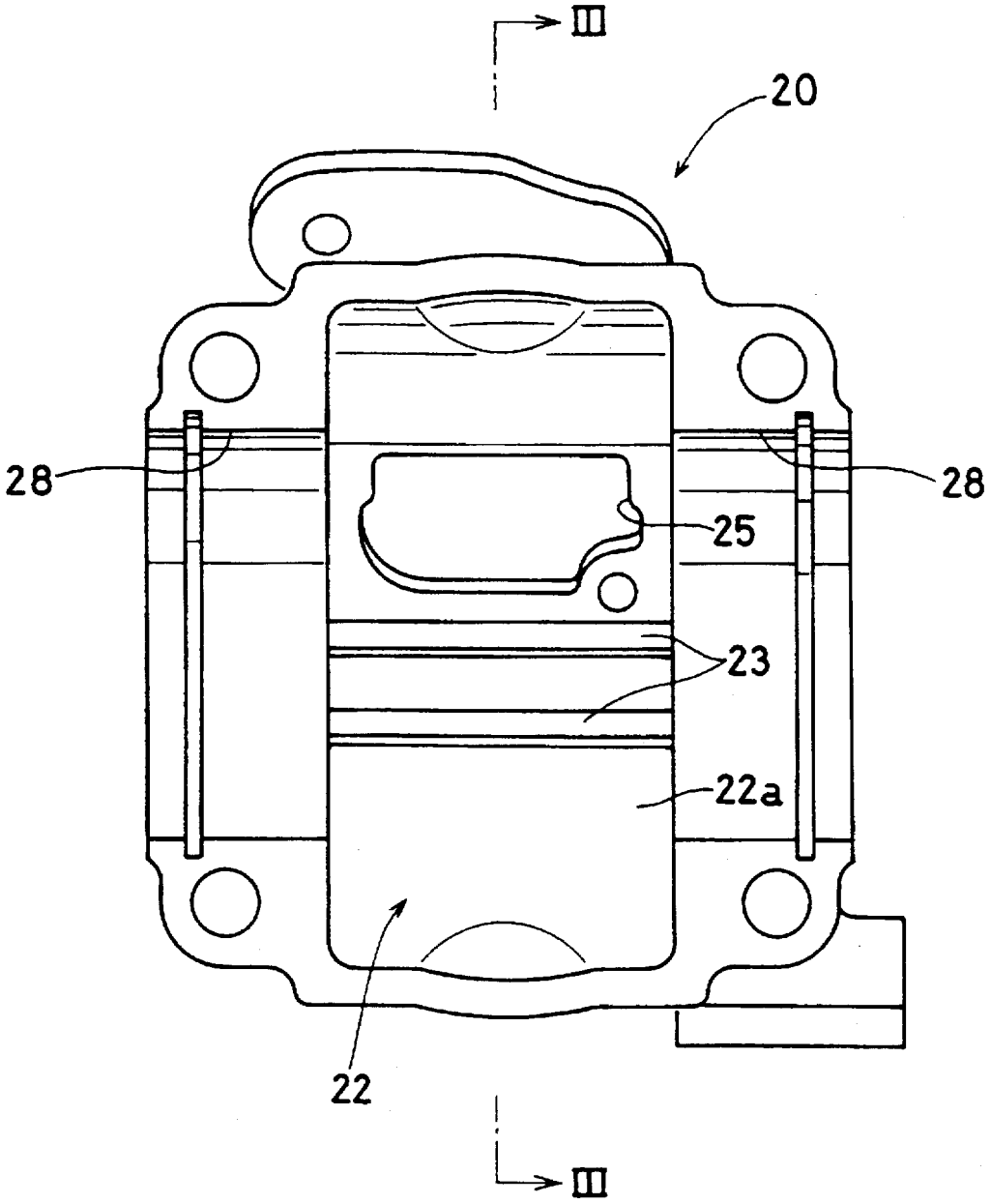
FIG. 2 is an enlarged cut-away view of the two-stroke internal combustion engine of FIG. 1, with the cut being along the line II—II and the view in the direction of the arrows in FIG. 1.
Figure 3:
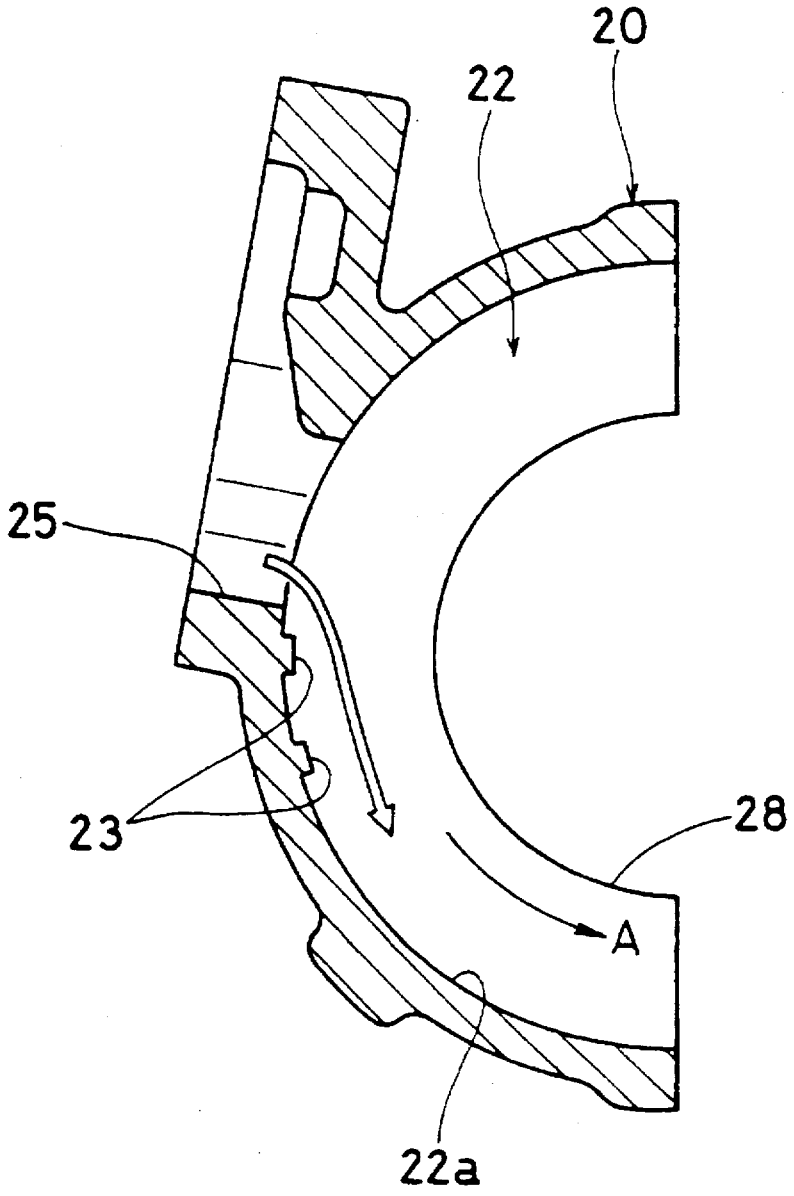
FIG. 3 is a vertical cross section taken along the line III—III and viewed in the direction of the arrows in FIG. 2.

With reference to FIGS. 2 and 3, two weirs 23 which have rectangular cross section are included suitably spaced as a flow control feature for retarding flow of non-atomized fuel at the inner surface 22*a* of the crank chamber 22 in the vicinity of the intake port 25, and so that the weirs 23 extend across the full width of the crank chamber 22 in parallel with the crank shaft 15. In FIGS. 2 and 3, bearing mounting portions 28 are for mounting bearings (not shown) for the crank shaft 15.

With the two-stroke internal combustion engine 2 constructed as described above, when the chain saw 1 is operated with its distal end down or with its operative portion 6 slanting down for a certain period of time, non-atomized fuel deposited on the inner surface, in particular on the circumferential inner surface 22*a* of the crank chamber 22, is forced to flow across the weirs 23 which form flow control feature, and thus can flow but slowly into the intake port 25 and collect in the region thereof.

Thereafter, when the chain saw is turned up and held with its distal end up or with its operative portion 6 slanting up, the non-atomized fuel which has collected in the region of the intake port 25 begins to flow as indicated by the arrow shown in contour in FIG. 3. This flow is hampered by the weirs 23 and thereby greatly retarded. As a result, the non-atomized fuel is prevented from precipitously flowing along the circumferential inner surface 22*a* of the crank chamber 22 into the combustion chamber 17, and engine stall or the like is prevented.

Various modifications are encompassed within the scope of the appended claims, e.g., as different shapes and different numbers of flow control features can be used for preventing or retarding non-atomized fuel from flowing along the circumferential inner surface of the crank case. Other than a pair of weirs as specifically described above, or in addition thereto, the flow control feature can include a groove, a recess, or fine concavities and/or convexities formed, e.g., by satin-finishing or embossing an area of the circumferential inner surface of the crank chamber in the vicinity of the intake port.

By virtue of the flow control feature provided at the circumferential inner surface of the crank chamber in the vicinity of the intake port, non-atomized fuel which has collected in the region of the intake port and which otherwise would have gushed into the crank chamber upon directional change of the engine is retarded. Thus, non-atomized fuel is prevented from precipitously flowing along the circumferential inner surface of the crank chamber into the combustion chamber, and engine stall or the like is prevented.

We claim:

1. A two-stroke internal combustion engine comprising:

a crank case forming a crank chamber and having an intake port opening into the crank chamber;

a carburetor connected to said intake port via a lead valve;

a crank shaft rotatably disposed in the crank chamber; and a flow control feature for retarding flow of non-atomized fuel, disposed at a circumferential inner surface of the crank chamber in the vicinity of the intake port opening and downstream from said lead valve.

2. The engine according to claim 1, wherein the flow control feature comprises at least one of a weir, a groove, and a recess.

3. The engine according to claim 2, wherein the weir, groove or recess extends parallel to the crank shaft and full-width across the crank chamber.

* * * * *